US010022683B2

(12) United States Patent
Multner et al.

(10) Patent No.: US 10,022,683 B2
(45) Date of Patent: Jul. 17, 2018

(54) STIRRING DEVICE

(71) Applicant: EKATO Rühr- und Mischtechnik GmbH, Schopfheim (DE)

(72) Inventors: Benjamin Multner, Wehr (DE); Wolfgang Keller, Sierentz (FR)

(73) Assignee: EKATO Rühr- und Mischtechnik GmbH, Schopfheim (DE)

( * ) Notice: Subject to any disclaimer, the term of this patent is extended or adjusted under 35 U.S.C. 154(b) by 0 days.

(21) Appl. No.: 15/553,335

(22) PCT Filed: Feb. 22, 2016

(86) PCT No.: PCT/EP2016/053623
§ 371 (c)(1),
(2) Date: Aug. 24, 2017

(87) PCT Pub. No.: WO2016/135073
PCT Pub. Date: Sep. 1, 2016

(65) Prior Publication Data

US 2018/0071698 A1 Mar. 15, 2018

(30) Foreign Application Priority Data

Feb. 27, 2015 (DE) ..... 10 2015 102 888

(51) Int. Cl.
*B01F 7/00* (2006.01)
*B01F 7/16* (2006.01)

(52) U.S. Cl.
CPC ..... *B01F 7/00033* (2013.01); *B01F 7/00025* (2013.01); *B01F 7/00291* (2013.01);
(Continued)

(58) Field of Classification Search
CPC ..... B01F 7/00033
(Continued)

(56) References Cited

U.S. PATENT DOCUMENTS 2,683,018 A * 7/1954 Schorner ..... F01D 5/284 416/134 R
5,292,193 A 3/1994 Funk
(Continued)

FOREIGN PATENT DOCUMENTS

DE 101 34 316 A1 1/2003
DE 203 19 813 U1 5/2004
(Continued)

OTHER PUBLICATIONS

German Search Report dated Nov. 27, 2015 for the corresponding DE application No. 10 2015 102 888.3 (English translation attached).
(Continued)

*Primary Examiner* — David Sorkin
(74) *Attorney, Agent, or Firm* — Posz Law Group, PLC

(57) ABSTRACT

A stirring device has at least one at least substantially metallic stirring blade carrier and a plurality of stirring blades, which are connected to the stirring blade carrier, wherein the stirring blades are at least substantially made of a non-metallic material, wherein the non-metallic material is a ceramic material, wherein the stirring blades are releasably connected to the stirring blade carrier, wherein it is possible to release and/or establish a mechanical, namely a negative-fit and/or positive-fit connection between the stirring blades and the stirring blade carrier in a damage-free and/or non-destructive manner, and wherein the stirring blade carrier comprises at least one recess, which is configured to at least partly accommodate at least one of the stirring blades.
The recess comprises at least one partial region implemented in a contiguous fashion if viewed in parallel to a rotational axis of the stirring blade carrier.

16 Claims, 5 Drawing Sheets

Figure 1:
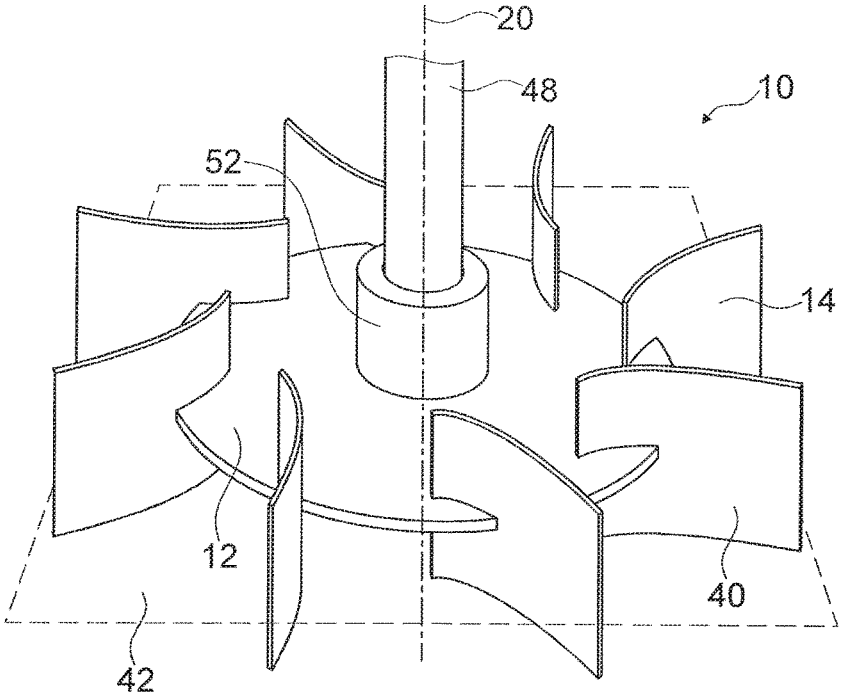

(52) U.S. Cl.
CPC ..... *B01F 7/00383* (2013.01); *B01F 7/00633* (2013.01); *B01F 7/167* (2013.01)

(58) Field of Classification Search
USPC ..... 416/241 B; 366/317
See application file for complete search history.

(56) References Cited

U.S. PATENT DOCUMENTS

| | | | |
|---|---|---|---|
| 5,409,313 | A | 4/1995 | Funk |
| 5,947,599 | A | 9/1999 | Funk |
| 5,951,162 | A | 9/1999 | Weetman et al. |
| 2008/0199321 | A1 | 8/2008 | Gigas et al. |

FOREIGN PATENT DOCUMENTS

| | | | |
|---|---|---|---|
| DE | 10 2008 008 507 | A1 | 8/2008 |
| EP | 0 175 556 | B1 | 3/1986 |

OTHER PUBLICATIONS

1st German OA dated Nov. 27, 2015 for the corresponding DE application No. 10 2015 102 888.3 (English translation attached).

2nd German OA dated Apr. 20, 2017 for the corresponding DE application No. 10 2015 102 888.3(English translation attached).

International Preliminary Report on Patentability (Chapter II) dated Jun. 12, 2017 issued in corresponding International Patent Application No. PCT/EP2016/053623. (and German version of Jun. 12, 2107 with Article 34 amendments).

International Search Report of the International Searching Authority dated May 31, 2016 issued in corresponding International Patent Application No. PCT/EP2016/053623.

Office Action dated Sep. 19, 2017 in the corresponding Canadian Patent Application No. 2,977,705.

* cited by examiner

STIRRING DEVICE

CROSS REFERENCE TO RELATED APPLICATIONS

This application is a U.S. national stage application of PCT/EP2016/053623 filed on Feb. 22, 2016, which claims priority to German Patent Application No. DE 10 2015 102 888.3 filed on Feb. 27, 2015, the contents of which are incorporated herein by reference.

STATE OF THE ART

The invention relates to a stirring device according to the preamble of claim 1.

Stirring devices with stirring blades for stirring, mixing, homogenization, dispersion and/or suspension in media, are known.

As described in U.S. Pat. No. 5,409,313 A and U.S. Pat. No. 5,947,599A, as well as U.S. Pat. No. 5,292,193 A, stirring elements with a stirring blade carrier and with a plurality of stirring blades, which are connected to the stirring blade carrier, are known, wherein the stirring blades may be made at least substantially of a ceramic material.

The objective of the invention is in particular to provide a stirring device having improved characteristics regarding a stirring blade material.

ADVANTAGES OF THE INVENTION

The invention is based on a stirring device with at least one at least substantially metallic stirring blade carrier and with a plurality of stirring blades which are connected to the stirring blade carrier, wherein the stirring blades are at least substantially made of a non-metallic material. By a "stirring device" is in particular, in this context, at least one part and/or assembly group to be understood, in particular a sub-assembly group, of a stirring element, in particular of an axially conveying and/or radially conveying stirring element. In particular, the stirring device may comprise the whole stirring element, in particular the entire axially conveying and/or radially conveying stirring element. In particular, the stirring element is herein different from a propeller and/or fan wheel, in particular for the conveyance of air. By a "stirring blade carrier" is in particular, in this context, a unit or an element to be understood which is configured for accommodation and/or arrangement of a plurality of stirring blades. "Configured" is in particular to mean specifically designed and/or equipped. By an object being configured for a certain function is in particular to be understood that he object fulfills and/or implements said certain function in at least one application state and/or operation state. Furthermore, the stirring blade carrier is in particular configured for transferring, in particular directly transferring, a rotational movement of a stirring shaft onto the stirring blades that are connected to the stirring blade carrier. By the stirring blade carrier being "at least substantially metallic" is in particular to be understood, in this context, that the stirring blade carrier is made at least to a large extent and particularly preferably entirely of an alloy and/or a metal, in particular stainless steel, duplex stainless steel and/or advantageously titanium, in particular titanium of any grade, preferably with a grade of at least 2 and maximally 12. The term "at least to a large extent" is herein to mean, in particular, at least by 50%, preferably at least by 70% and especially preferentially at least by 90%. The stirring blade carrier may moreover in particular comprise at least one stirring element hub, which is in particular configured to accommodate, in at least one operation state, at least one stirring shaft and/or to be fixated to the at least one stirring shaft. Herein the at least one stirring shaft defines in particular the rotational axis. In particular, the at least one stirring element hub may be made at least partly, preferably at least to a large extent and especially preferentially entirely, of an alloy and/or a metal, in particular stainless steel, duplex stainless steel and/or advantageously titanium. Advantageously the at least one stirring element hub is made of the same material as the stirring blade carrier. In particular, the at least one stirring element hub is connectable and or fixatable to the at least one stirring shaft in particular via an additional fastening unit, e.g. via at least one flange. By the stirring blades being "made at least substantially of a non-metallic material" is in particular to be understood, in this context, that the stirring blades are made in particular by at least 50%, preferably by at least 70% and especially preferentially by at least 90% of an organic material or material mix, e.g. a synthetic material, and/or a non-metallic inorganic material or material mix, e.g. a ceramic material.

By such an implementation a stirring device may be rendered available with improved characteristics regarding a stirring blade material. In particular, an already known metallic stirring blade carrier is advantageously combinable with stirring blades of a non-metallic material, which are adapted to a respective application. In particular, it is possible to implement an advantageously simple and/or cost-effective adaptation and/or optimization and/or design of the stirring device, for example as regards wear-down characteristics, hygiene characteristics, weight and/or other material-related characteristics.

The non-metallic material is a ceramic material. By a "ceramic material" is in particular, in this context, an inorganic non-metallic material to be understood. In particular, the ceramic material may be at least partly crystalline. In particular, the ceramic material is at least largely free from metallic characteristics, in particular metallic characteristics due to metallic bonding, but may comprise metal compounds, e.g. metal oxides and/or metal silicates. Preferably the ceramic material is implemented, at least to a large extent, by a non-oxide ceramic material, in particular aluminum nitride, boron carbide and/or preferably silicon nitride and/or silicon carbide. This allows achieving an advantageous wear-resistance of the stirring blades and thus an advantageously long service life of the stirring device.

The stirring blades are releasably connected to the stirring blade carrier. "Releasably connected" is in particular to mean, in this context, that it is possible to release and/or establish a mechanic, in particular negative-fit and/or positive-fit connection between the stirring blades and the stirring blade carrier, in particular without a tool and/or by means of a mounting tool in a damage-free and/or non-destructive manner. This allows providing an advantageously simple and/or quick replaceability of the stirring blades, in particular in case of wear-down.

The stirring blade carrier comprises at least one recess which is configured to accommodate at least one of the stirring blades at least partly. In particular, the stirring blade carrier comprises a plurality of recesses (which are in particular embodied identically to each other), each of which is provided to partly accommodate one of the stirring blades. The recesses are arranged, in particular in particular equidistantly from each other, in a circumferential direction of the stirring blade carrier. This allows fixating the stirring blades to the stirring blade carrier in an advantageously stable fashion.

The recess comprises at least one partial region, which is implemented in a contiguous fashion if viewed in parallel to a rotational axis of the stirring blade carrier.

Preferentially all recesses comprise respectively one partial region which is embodied contiguous, viewed in parallel to a rotational axis of the stirring blade carrier. The at least one partial region is in particular introduced into the stirring blade carrier in slit-form. A course of the partial region corresponds at least substantially to an outer contour of the stirring blade. In this way an advantageous arrangement of the stirring blades on the stirring blade carrier is achievable.

Beyond this it is proposed that the stirring blade carrier comprises at least one carrier element, which is implemented at least substantially disc-shaped. By a "carrier element" is in particular, in this context, an element to be understood which is configured to fixate the stirring blades to the stirring blade carrier. The carrier element is preferentially embodied in a one-part implementation with the stirring blade carrier and/or is at least partly implemented by the stirring blade carrier itself. It is in particular conceivable that the carrier element is embodied in a one-part implementation and/or in a multi-part implementation, in particular in two parts, preferably in four parts, particularly preferably with identical stirring element hub portions. "In a one-part implementation" is in particular, in this context, to mean at least by substance-to-substance bond. The substance-to-substance bond may be established, for example, by an adhesive bonding process, an injection-molding process, a welding process, a soldering process and/or via any other process that is deemed expedient by someone skilled in the art. Advantageously, however, "embodied in a one-part implementation" is to mean formed in one piece. Said piece is preferably produced from a single blank and/or cast. Moreover, an "at least substantially disc-shaped" implementation of an object is in particular to mean an implementation of the object in which a smallest rectangular cuboid, in particular imaginary rectangular cuboid, which just still encloses the object, has a longest edge that has in particular a ten-fold to 25-fold length of the smallest edge of the rectangular cuboid. The carrier element preferentially comprises an at least substantially circle-shaped base surface. In this way an advantageously simple arrangement of stirring blades on the stirring blade carrier is achievable. Furthermore the stirring device may be embodied as a radially conveying stirring device in an advantageously simple and/or cost-effective manner.

In a preferred implementation of the invention it is proposed that the stirring blade carrier comprises at least two disc-shaped carrier elements, which are embodied corresponding to each other and are configured to accommodate, in a mounted state, the stirring blades at least partly in a region between the carrier elements. In particular, the two carrier elements are configured to fixate the stirring blades in a mounted state in a positive-fit manner and/or in particular via a clamping force in a negative-fit manner. In particular, the carrier elements are in a mounted state connected to each other by means of at least one screwing and preferably by means of a plurality of screwings. This allows achieving an advantageously simple and/or secure fixation of the stirring blades.

It is also proposed that the stirring blades comprise at least one blade element and at least one fixation protrusion, which is connected to the blade element in a one-part implementation. By a "blade element" is in particular, in this context, an element to be understood which at least partially forms an effective surface of a stirring blade. By a "fixation protrusion" is in particular, in this context, a geometrical unit and/or an, in particular geometrical, shaping to be understood which is in particular arranged on at least one surface and/or at least one partial region of the blade element. The term "in a one-part implementation" is to mean, in this context, that at least one element of the fixation protrusion and/or the fixation protrusion is embodied in a one-part implementation with the blade element of the stirring blade. In particular, the fixation protrusion is configured for establishing a negative-fit and/or positive-fit connection to the stirring blade carrier and in particular to at least one carrier element of the stirring blade carrier. In this way it is possible to advantageously simplify a fixation of the stirring blades and to effect an advantageously secure connection between the stirring blades and the stirring blade carrier.

Furthermore it is proposed that the fixation protrusion comprises at least one recess, which is configured to accommodate at least one fixation element. In particular, the fixation protrusion comprises a plurality of recesses. The recesses are in particular configured to accommodate, for example, a screw or a bolt, by means of which the stirring blade comprising the fixation protrusion is fixable to the stirring blade carrier and in particular to a carrier element of the stirring blade carrier. This allows achieving an advantageously simple and/or cost-efficient fixation of the respective stirring blades. Moreover an assembly input for replacement of individual stirring blades may be advantageously reduced.

It is further proposed that a blade element of the stirring blades comprises at least one recess which is configured to accommodate at least one fixation element. The recesses are in particular configured to accommodate, for example, a screw or a bolt via which the stirring blade comprising the fixation protrusion is fixable to the stirring blade carrier and in particular to a carrier element of the stirring blade carrier. The recess extends in particular at least substantially perpendicularly to an effective surface of the stirring blade. Preferentially the stirring blade is, in an implementation with a recess in a blade element, free of fixation protrusions. In this way an advantageously simple and/or cost-efficient fixation of the individual stirring blades is achievable. Furthermore a mounting effort for replacing individual stirring blades is advantageously reducible. Beyond this an advantageously simple stirring blade geometry is achievable.

It is moreover proposed that the stirring blades and the stirring blade carrier are implemented in such a way that, in a mounted state, in particular during a stirring operation, force flows from the stirring blades into the stirring blade carrier always go at least substantially perpendicularly to a contact surface between the respective stirring blade and the stirring blade carrier. The term "substantially perpendicularly" is herein in particular to mean an orientation of a direction with respect to a reference direction, the direction and the reference direction including, in particular viewed in a plane, an angle of 90° and the angle having a maximum deviation of in particular less than 80°, advantageously less than 5° and especially advantageously less than 2°. As a result of this, it is advantageously achievable that, in particular in a contact region with the stirring blade carrier, a pressure load is applied to the stirring blades and a tension load is avoided at least largely. This allows avoiding damages to ceramic stirring blades, in particular damages due to tension loads.

Beyond this it is proposed that an effective surface of the stirring blades is in the mounted state oriented at least substantially perpendicularly to a rotational plane of the stirring blade carrier. The term "substantially perpendicularly" is herein in particular to mean an orientation of a direction with respect to a reference direction, the direction and the reference direction including, in particular viewed in a plane, an angle of 90° and the angle having a maximum deviation of in particular less than 8°, advantageously less than 5° and especially advantageously less than 2°. As a result of this, it is achievable that the stirring device has an advantageously great power coefficient, the stirring device thus featuring an advantageously higher power input, in particular in comparison to differently implemented stirring devices having the same stirring element diameter and the same circumferential speed.

Furthermore a stirring agitator is proposed, with at least one drive unit, at least one stirring shaft and at least one stirring device which is drivable via the stirring shaft. In this way a stirring agitator with an advantageously improved service life and advantageously simplified maintenance characteristics may be rendered available.

In addition, a Pressure-Oxide Autoclave (POX autoclave) with at least one stirring agitator is proposed. The POX autoclave is configured in particular for ore processing. The POX autoclave comprises at least one, in particular horizontally arranged, container, in particular pressure container, and is in particular configured for accommodating an abrasive medium. A stirring shaft of the stirring agitator is preferably arranged perpendicularly to a container axis, which is in particular arranged horizontally, and/or perpendicularly to the container. In particular, the POX autoclave may also comprise a plurality of stirring agitators, wherein at least two and/or at least three stirring agitators may be arranged, respectively side by side. Furthermore, in particular partially permeable, in particular media-permeable, separating walls, which are in particular arranged horizontally and/or vertically, may be arranged in particular between the respective stirring agitators, as a result of which in particular a continuous stirring process is achievable. The system may in particular comprise at least one separating wall and/or the abrasive medium, which is in particular located in the container. This allows in particular providing a POX autoclave, in particular for ore processing, which is optimized, in particular as regards wear-down, and has a long service life, namely a POX autoclave with improved characteristics regarding service life, maintenance intervals and/or replacement intervals.

The stirring device is herein not to be restricted to the application and implementation described above. In particular, for fulfilling a functionality herein described, the stirring device may comprise a number of respective elements, structural components and units that differs from a number that is mentioned herein.

DRAWINGS

Further advantages will become apparent from the following description of the drawings. The drawings show three exemplary embodiments of the invention. The drawings, the description and the claims contain a plurality of features in combination. Someone skilled in the art will purposefully also consider the features individually and will find further expedient combinations.

Figure 2:
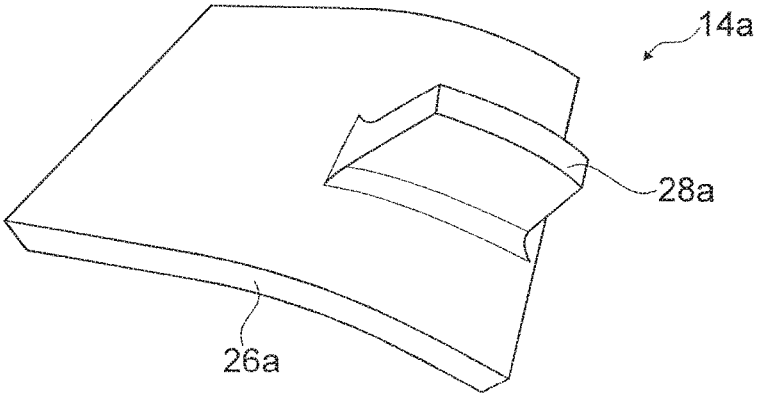
Figure 3:
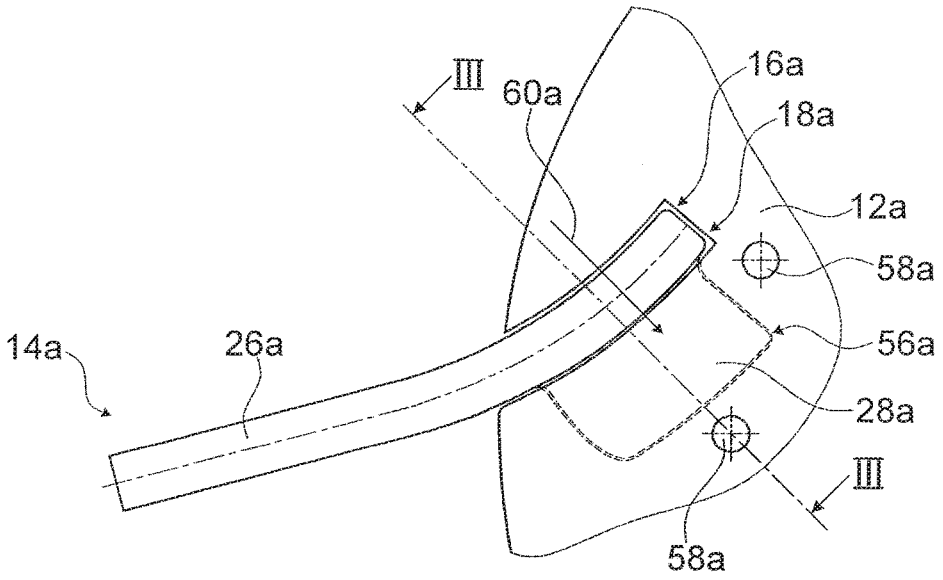
Figure 4:
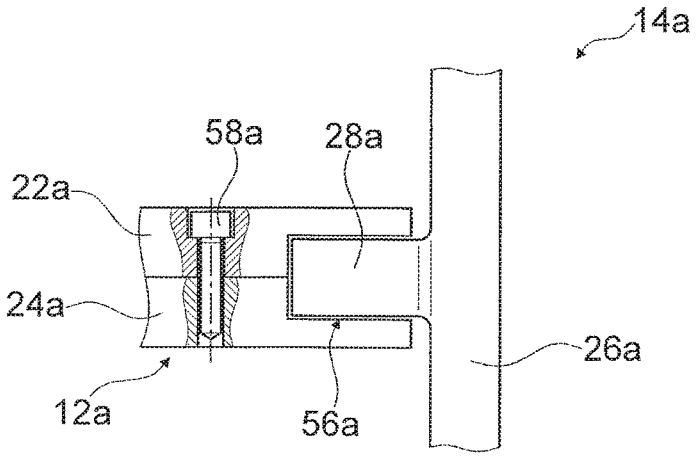
Figure 5:
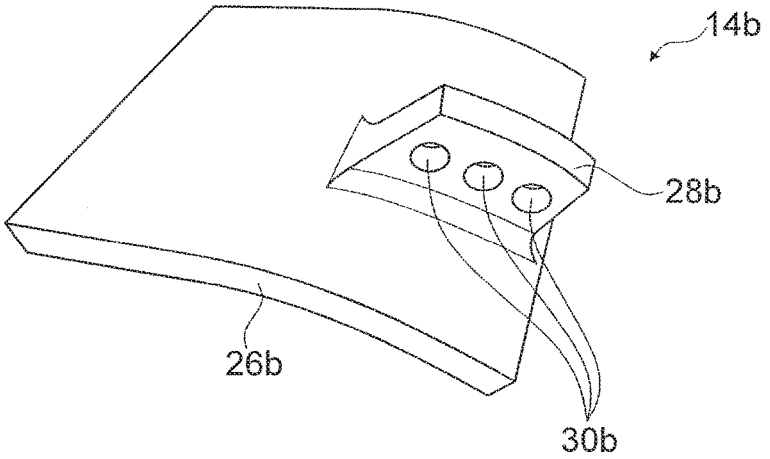
Figure 6:
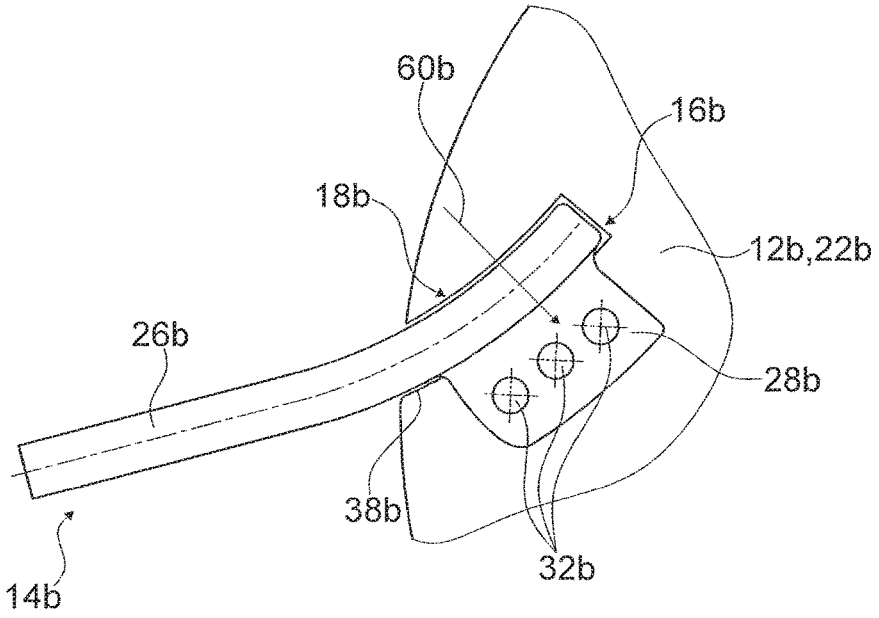
Figure 7:
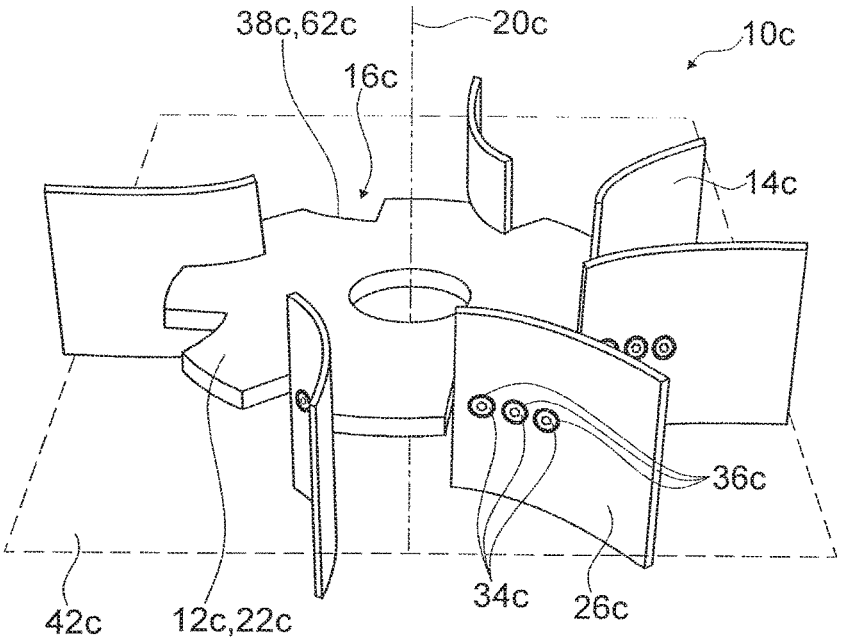
Figure 8:
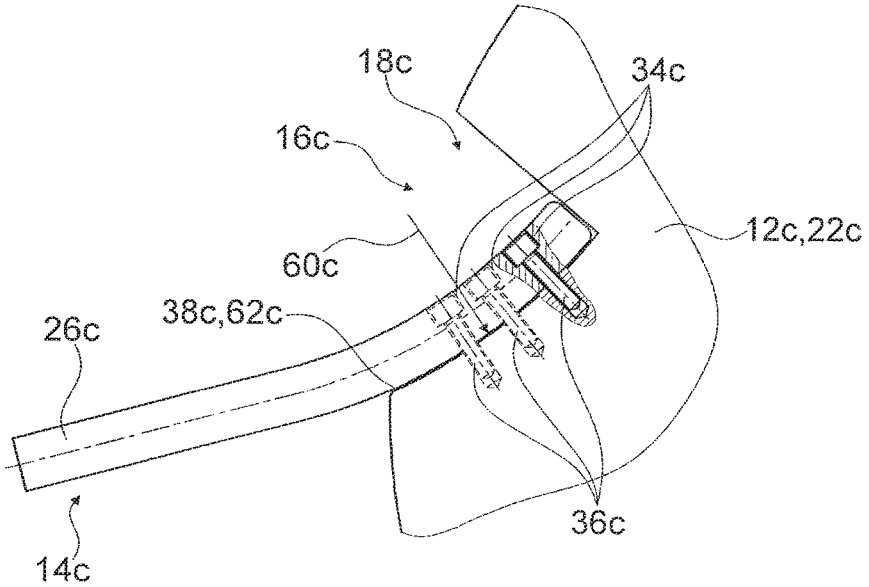
Figure 9:
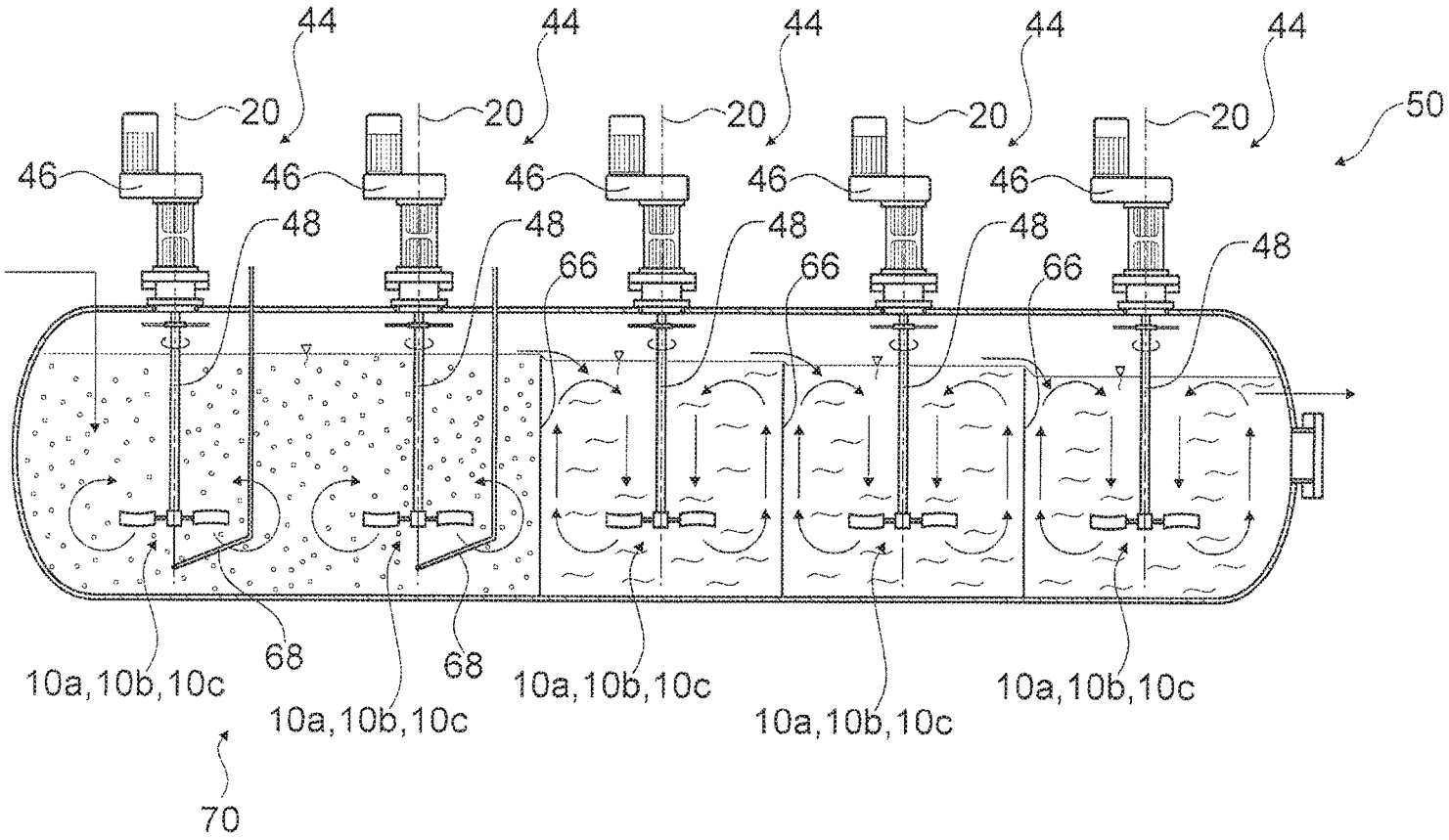

It is shown in:

FIG. 1 a stirring device embodied as a radial stirring agitator, in a perspective view, FIG. 2 a stirring blade of a stirring device, FIG. 3 a section of a stirring blade carrier with a mounted stirring blade according to FIG. 2, FIG. 4 a sectional view of the stirring blade carrier with the mounted stirring blade of FIG. 3, FIG. 5 an alternative stirring blade of a stirring device, FIG. 6 a section of a stirring blade carrier with a mounted stirring blade according to FIG. 5, FIG. 7 an alternative implementation of a stirring device, FIG. 8 a section of a stirring blade carrier with a mounted stirring blade according to FIG. 7, and FIG. 9 a POX autoclave with five stirring agitators, each comprising a stirring device according to one of FIGS. 1 to 8.

DESCRIPTION OF THE EXEMPLARY EMBODIMENTS

FIG. 1 exemplarily shows a stirring device 10 embodied as a radial stirring agitator, in a mounted state in a perspective view. The stirring device 10 comprises a metallic stirring blade carrier 12. In the present case the stirring blade carrier 12 is, for example, made of grade 12 titanium. Furthermore the stirring device 10 comprises a plurality of stirring blades 14, which are connected to the stirring blade carrier 12. The stirring blades 14 are made of a non-metallic material. Preferably the stirring blades 14 are made of a ceramic material, advantageously a non-oxide ceramic, e.g. silicon nitride or silicon carbide. The stirring blades 14 are arranged on the stirring blade carrier 12 in a circumferential direction. In the shown embodiment, eight stirring blades 14 are exemplarily depicted wherein, however, any differing number is also conceivable. The stirring device 10 further comprises a stirring element hub 52, which is arranged on the stirring blade carrier 12. The stirring element hub 52 is configured to accommodate, in at least one operation state, a stirring shaft 48. The stirring element hub 52 is configured for mounting the stirring device 10 axially to the stirring shaft 48. An orientation of the stirring shaft 48 defines a rotational axis 20 of the stirring device 10. The stirring blades 14 are, in the mounted state shown, arranged on the stirring blade carrier 12 in such a way that an effective surface 40 of the stirring blades 14 is oriented respectively perpendicularly to a rotational plane 42 of the stirring blade carrier 12.

FIG. 2 shows an embodiment of a stirring blade 14*a*. The stirring blade 14*a* comprises a blade element 26*a* and a fixation protrusion 28*a*, which is embodied in a one-part implementation with the blade element 26*a*. FIG. 3 shows a section of the stirring blade carrier 12*a* with a mounted stirring blade 14*a* in a plan view. The stirring blade carrier 12*a* comprises in the section shown a recess 16*a*, which is configured to partly accommodate the stirring blade 14*a*. The recess 16*a* herein comprises a partial region 18*a*, which, viewed in parallel to the rotational axis 20*a* of the stirring blade carrier 12*a*, is implemented in a contiguous fashion. The stirring blade carrier 12*a* comprises a number of identical recesses 16*a* which corresponds to a number of stirring blades 14*a* that are to be mounted. FIG. 4 shows a sectional view along the section line III-III. The stirring blade carrier 12*a* comprises in the present embodiment two disc-shaped carrier elements 22*a*, 24*a*, which correspond to each other and are configured to accommodate, in a mounted state, the fixation protrusion 28*a* of the stirring blades 14*a* between the carrier elements 22*a*, 24*a*. For this purpose the carrier elements 22*a*, 24*a* form a region 56*a*, which corresponds to the fixation protrusion 28*a*, in which the fixation protrusion 28*a* is fixated in negative-fit and positive-fit fashion in a mounted state. While the fixation protrusion 28*a* is arranged between the disc-shaped carrier elements 22*a*, 24*a*, the blade element 26*a* protrudes over the stirring blade carrier 12*a* on both sides. In the mounted state the carrier elements 22*a*, 24*a* are connected to each other via fixation elements 58*a*.

When the fixation elements 58*a* are released, the stirring blades 14*a* are removable from the stirring blade carrier 12*a*, the stirring blades 14*a* being thus connected to the stirring blade carrier 14*a* releasably. This allows, e.g. in case of wear-down, simple replacement of individual or all stirring blades 14*a*.

The stirring blades 14*a* and the stirring blade carrier 12*a* are implemented in such a way that, in a mounted state, force flows 60*a* always, in particular during stirring operation, go perpendicularly from the stirring blades 14*a* into the fixation protrusions 28*a* of the stirring blades 14*a*. In this way it is achievable that, in particular during a stirring operation, a pressure load is applied onto the stirring blades 14*a*, while tension loads are avoided at least largely.

FIGS. 5 to 8 show further exemplary embodiments of the invention. The following description and the drawings are substantially restricted to the differences between the exemplary embodiments while regarding identically designated structural components, in particular regarding structural components with the same reference numerals, principally the drawings and/or descriptions of the other exemplary embodiments, in particular of FIGS. 2 to 4, may be referred to. For distinguishing the exemplary embodiments, the letter a is added to the reference numerals of the exemplary embodiment in FIGS. 2 to 4. In the exemplary embodiments of FIGS. 5 to 8 the letter a has been substituted by the letters b and c.

FIG. 5 shows an alternative implementation of a stirring blade 14*b*. The stirring blade 14*b* comprises a blade element 26*b* and a fixation protrusion 28*b*, which is embodied in a one-part implementation with the blade element 26*b*. The fixation protrusion 28*b* comprises recesses 30*b*, which are configured for accommodating fixation elements 32*b*. FIG. 6 shows a section of the stirring blade carrier 12*b* with a mounted stirring blade 14*b* in a plan view. In the section shown, the stirring blade carrier 12*b* comprises a recess 16*b*, which is configured to partly accommodate the stirring blade 14*b*. The recess 16*b* herein comprises a partial region 18*b* which is, viewed in parallel to a rotational axis 20*b* of the stirring blade carrier 12*b*, embodied in a contiguous fashion. The stirring blade carrier 12*b* comprises a number of identical recesses 16*b* which corresponds to a number of stirring blades 14*b* that are to be mounted. The stirring blade 14*b* is releasably connected to the stirring blade carrier 12*b* via fixation elements 32*b*, which are guided through the recesses 30*b* of the fixation protrusion 28*b*. Herein the fixation protrusion 28*b* lies upon a surface of a disc-shaped carrier element 22*b* of the stirring blade carrier 12*b*, while the blade element 26*b* protrudes over the stirring blade carrier 12*b* on both sides. A simple exchange of individual stirring blades 14*b*, e.g. in case of wear-down, may be effected in a simple fashion by releasing the fixation elements 32*b*.

The stirring blades 14*b* and the stirring blade carrier 12*b* are implemented in such a way that, in a mounted state, force flows 60*b* always, in particular during a stirring operation, go perpendicularly from the stirring blades 14*b* into the fixation protrusions 28*b* of the stirring blades 14*b*. It is in this way achievable that, in particular during a stirring operation, a pressure load is applied onto the stirring blades 14*b* while tension loads are avoided at least largely.

FIG. 7 shows an alternative implementation of a stirring device 10*c*. The stirring device 10*c* comprises a metallic stirring blade carrier 12*c* and a plurality of ceramic stirring blades 14*c*, which are connected to the stirring blade carrier 12*c*. To clearly show the structure, only six of possible eight stirring blades 14*c* are depicted here in a mounted state. The stirring blade carrier 12*c* comprises a disc-shaped carrier element 22*c*. Furthermore the stirring blade carrier 12*c* comprises recesses 16*c*, which are arranged in a circumferential direction and are configured to partly accommodate the stirring blades 14*c*. FIG. 8 shows a section of the stirring blade carrier 12*c* with a stirring blade 14*c* that is mounted in one of the recesses 16*c*, in a plan view. The recess 16*c* is implemented triangle-shaped, wherein a side 62*c* of the recess 16*c* corresponds to an outer contour of the stirring blade 14*c*. For the purpose of fixating the stirring blade 14*c* to the stirring blade carrier 12*c*, a blade element 26*c* of the stirring blade 14*c* comprises recesses 34*c* for accommodating fixation elements 36*c*, e.g. screws. In a mounted state the stirring blade 14*c* is releasably connected to the stirring blade carrier 12*c* by means of the fixation elements 36*c*, the stirring blade 14*c* abutting on a contact surface 38*c* implemented by the side 62*c* of the recess 16*c* that corresponds to the outer contour of the stirring blade 14*c*.

The stirring blades 14*c* and the stirring blade carrier 12*c* are implemented in such a way that in a mounted state force flows 60*c* from the stirring blades 14*c* into the stirring blade carrier 12*c* always, in particular during a stirring operation, go perpendicularly to the contact surface 38*c*, between the respective stirring blade 14*c* and the stirring blade carrier 12*c*. It is thus achievable that a pressure load acts on the stirring blades 14*c*, in particular during a stirring operation, while tension loads are avoided at least largely.

FIG. 9 shows an example of a POX autoclave 50 with a horizontally arranged container 64 and a plurality of stirring agitators 44 arranged in the container 64. The stirring agitators 44 each comprise a drive unit 46, a stirring shaft 48 and a stirring device 10*a*, 10*b*, 10*c*, which is drivable by means of the stirring shaft 48. The container 64 is in the present case partitioned into four container regions by separating walls 66. The stirring agitators 44 are in the present case embodied identically. The stirring agitators 44 are arranged in the container 64 in such a way that a respective rotational axis 20 is arranged perpendicularly to a horizontally arranged container axis. In the present case the system comprises five stirring agitators 44. In a first container region 70 two stirring agitators 44 of the five stirring agitators 44 are arranged. In the further container regions respectively one further stirring agitator 44 is arranged. In an operating state an abrasive media is located in the container 64. The abrasive media is in the present case implemented as a suspension featuring a huge solid-matter load. Beyond this the POX autoclave 50 comprises, by way of example, two gas lances 68, which are arranged in the first container region 70. The gas lances 68 are configured to convey oxygen to the abrasive media in the first container region 70. Alternatively it is also conceivable to arrange a different number of and/or differently arranged and/or differently implemented stirring elements, which may in particular comprise a stirring device according to the invention, in a container.

The invention claimed is:

1. A stirring device comprising:

at least one at least substantially metallic stirring blade carrier; and a plurality of stirring blades that are releasably connected to the stirring blade carrier in a negative-fit mechanical connection and/or a positive-fit mechanical connection, the stirring blades are at least substantially made of a ceramic material, wherein the negative-fit mechanical connection and/or the positive-fit mechanical connection is establishable, and releasable, between the plurality of stirring blades and the stirring blade carrier in a damage-free and/or non-destructive manner, and wherein the stirring blade carrier comprises at least one recess per each of the plurality of stirring blades that is configured to accommodate at least one of the stirring blades at least partly, the recess comprises at least one partial region that is contiguous with respect to a view parallel to a rotational axis of the stirring blade carrier.

2. The stirring device according to claim 1, wherein the stirring blade carrier comprises at least one carrier element, which is at least substantially disc-shaped.

3. The stirring device according to claim 2, wherein the stirring blade carrier comprises at least two disc-shaped carrier elements, which mate to each other and are configured to accommodate, in a mounted state, the stirring blades at least partly in a region between the carrier elements.

4. The stirring device according to claim 1, wherein the stirring blades each comprise at least one blade element and at least one fixation protrusion, which is connected to the blade element in a one-part implementation.

5. The stirring device according to claim 4, wherein the fixation protrusion comprises at least one recess, which is configured to accommodate at least one fixation element.

6. The stirring device according to claim 4, wherein the blade element comprises at least one recess which is configured to accommodate at least one fixation element.

7. The stirring device according to claim 4, wherein the stirring blades and the stirring blade carrier are configured to, in a mounted state, force flows from the stirring blades into the stirring blade carrier always in a direction at least substantially perpendicular to a contact surface between the respective stirring blade and the stirring blade carrier and/or in a direction at least substantially perpendicular from the stirring blades into the fixation protrusion.

8. The stirring device according to claim 1, wherein an effective surface of the stirring blades is in the mounted state oriented at least substantially perpendicular to a rotational plane of the stirring blade carrier.

9. A stirring agitator with at least one drive unit, at least one stirring shaft and at least one stirring device according to claim 1, which is drivable via the stirring shaft.

10. A POX autoclave with at least one stirring agitator according to claim 9.

11. The stirring device according to claim 1, wherein the stirring blades each comprise at least one fixation protrusion, which extends perpendicular to an effective surface of the respective stirring blade.

12. The stirring device according to claim 1, wherein the stirring blades each comprise at least one fixation protrusion that is wing-shaped.

13. The stirring device according to claim 3, wherein the stirring blades each comprise at least one fixation protrusion, which is sandwiched between the carrier elements in a mounted state of the stirring blades.

14. The stirring device according to claim 1, wherein the stirring blades comprise a curved outer contour and the partial region of the recess corresponds at least substantially to the outer contour of the stirring blade.

15. The stirring device according to claim 1, wherein the partial region of the recess is skewed with respect to a rotational axis of the stirring blade carrier.

16. The POX autoclave according to claim 10, further comprising at least one container that is configured for accommodating an abrasive medium.

* * * * *